US006092716A

United States Patent [19]

Smith

[11] Patent Number: 6,092,716

[45] Date of Patent: Jul. 25, 2000

[54] COLLAPSE-RESISTANT, MERCHANDISE DISPLAY

[75] Inventor: Michael J. Smith, Orangeburg, N.Y.

[73] Assignee: Arrow Art Finishers, L.L.C., Princeton, N.J.

[21] Appl. No.: 09/187,604

[22] Filed: Nov. 6, 1998

[51] Int. Cl.[7] ..... B65D 5/36

[52] U.S. Cl. ..... 229/117.04; 229/117; 229/164; 229/178; 229/915

[58] Field of Search ..... 229/117, 117.03, 229/117.04, 164, 178, 915, 919, 117.01

[56] References Cited

U.S. PATENT DOCUMENTS

| | | | |
|---|---|---|---|
| D. 118,010 | 12/1939 | Broderick | 229/164 |
| 2,708,065 | 5/1955 | Inman | 229/117 |
| 2,844,297 | 7/1958 | Holmes | 229/117 |
| 3,040,961 | 6/1962 | Meyers | 229/164 |
| 4,369,913 | 1/1983 | Muise . | |
| 4,658,961 | 4/1987 | Tamura | 229/915 |
| 5,277,360 | 1/1994 | DeMott | 229/164 |
| 5,468,939 | 11/1995 | MacLean, IV . | |
| 5,799,818 | 9/1998 | Ringer | 229/117 |

FOREIGN PATENT DOCUMENTS

| | | | |
|---|---|---|---|
| 907963 | 10/1962 | United Kingdom . | |
| 1504570 | 3/1978 | United Kingdom | 229/117.01 |
| 8200987 | 4/1982 | WIPO | 229/117.01 |

*Primary Examiner*—Gary E. Elkins
*Attorney, Agent, or Firm*—Kirschstein , et al.

[57] ABSTRACT

Locking panels are employed to prevent the collapse of a merchandise display of the type having two sets of end closure flaps that arrange themselves into common closures in an erect condition of the display. Each locking panel overlies a respective closure and engages opposite walls of the display.

24 Claims, 6 Drawing Sheets

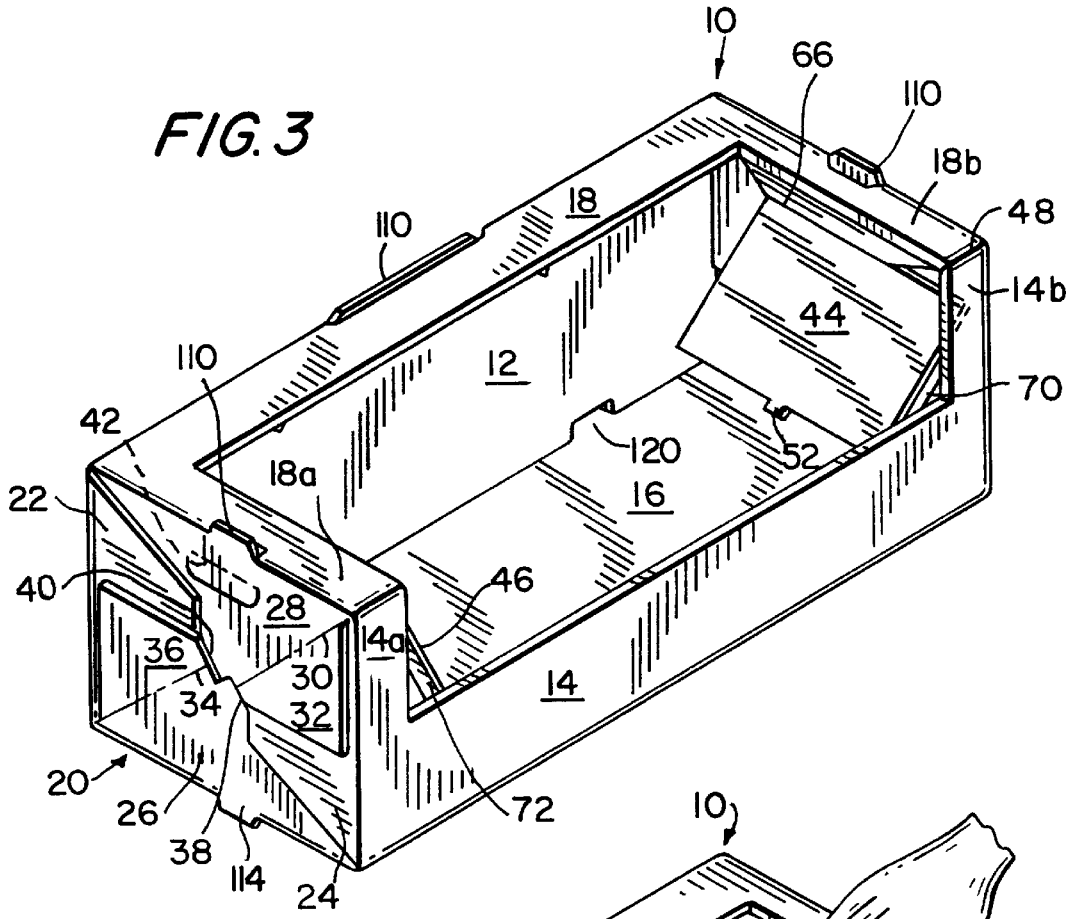
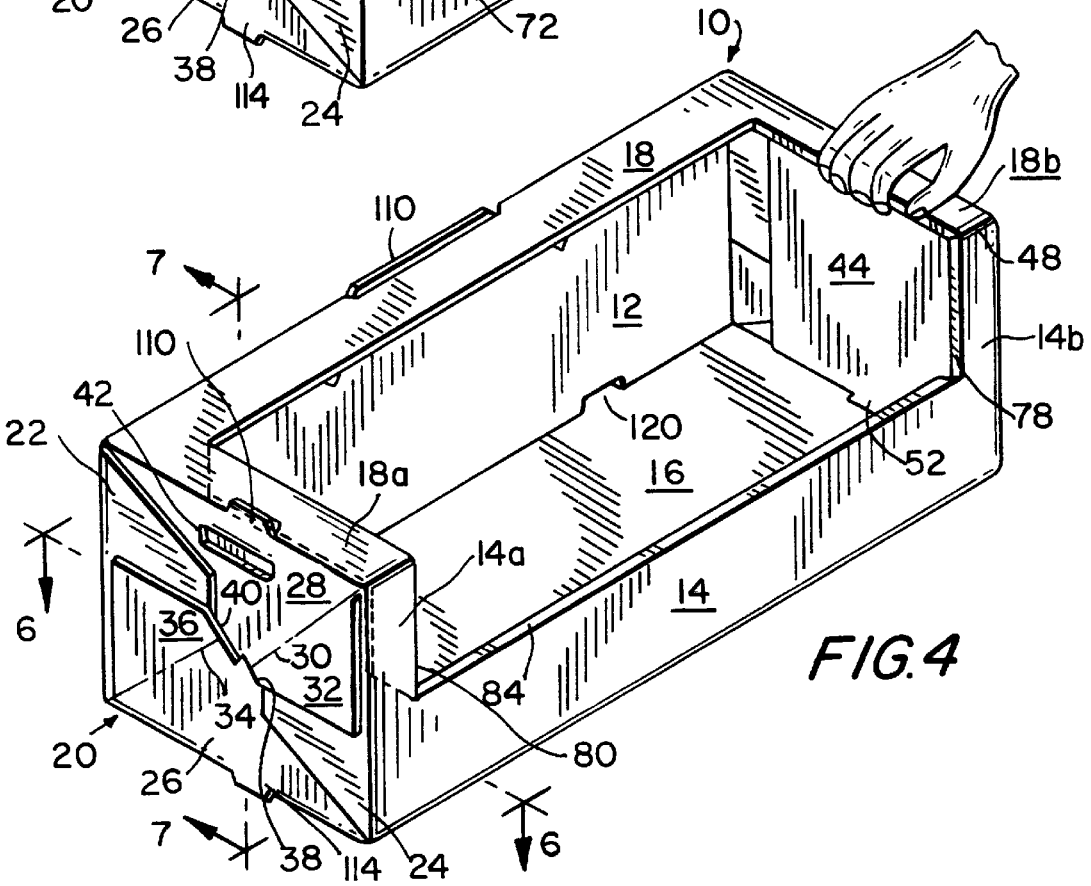
FIG. 4

FIG.8
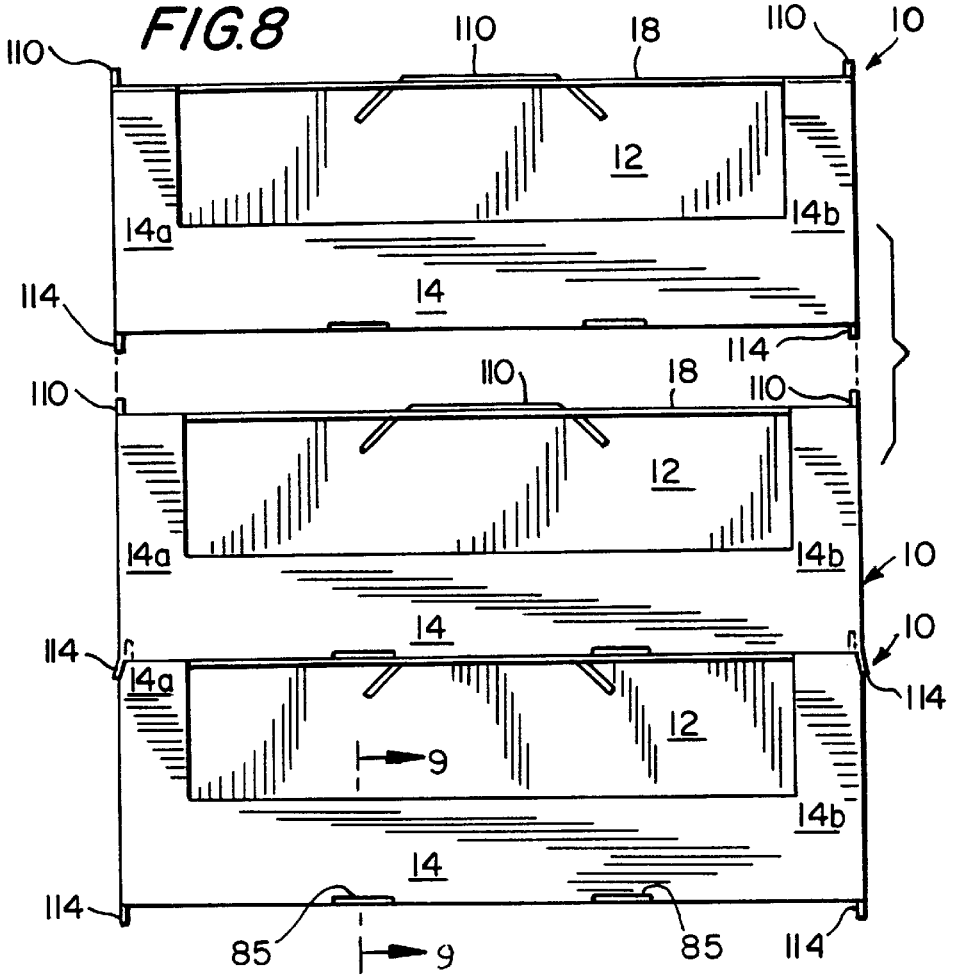
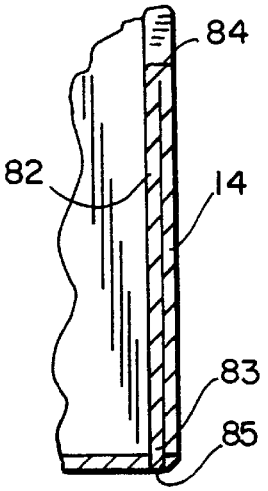
FIG.9
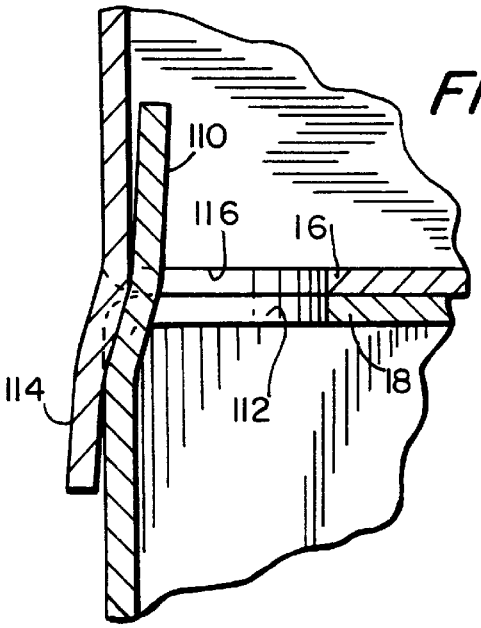
FIG.10

FIG.11
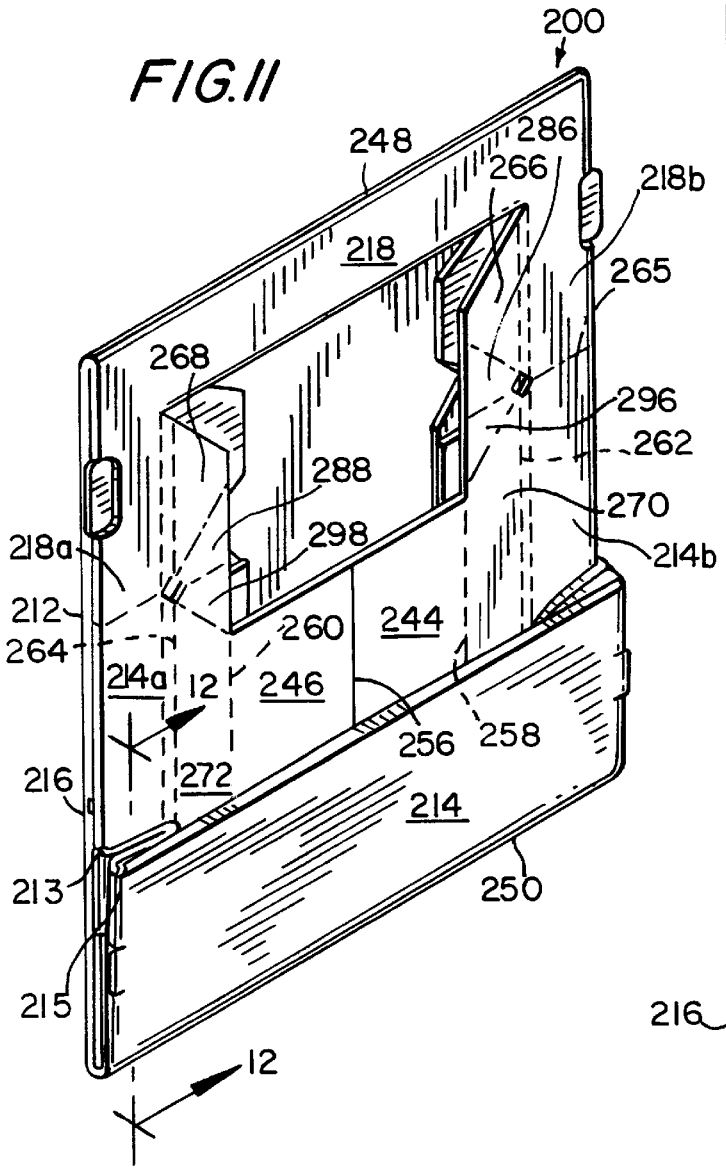
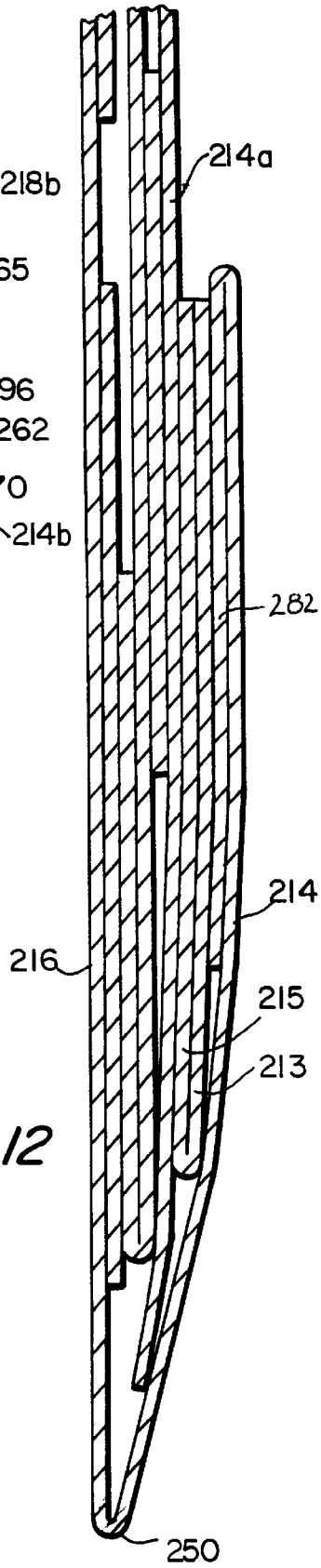
FIG.12

FIG.13
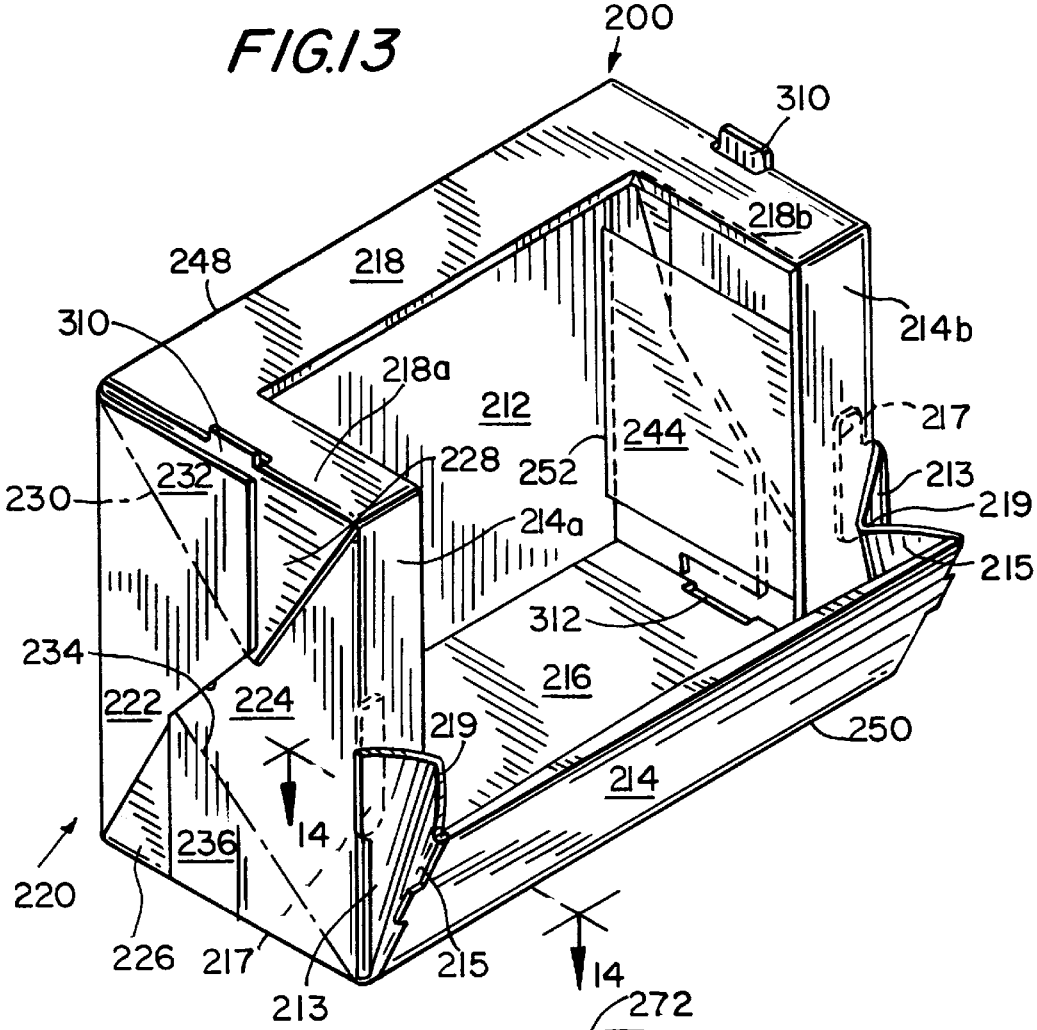
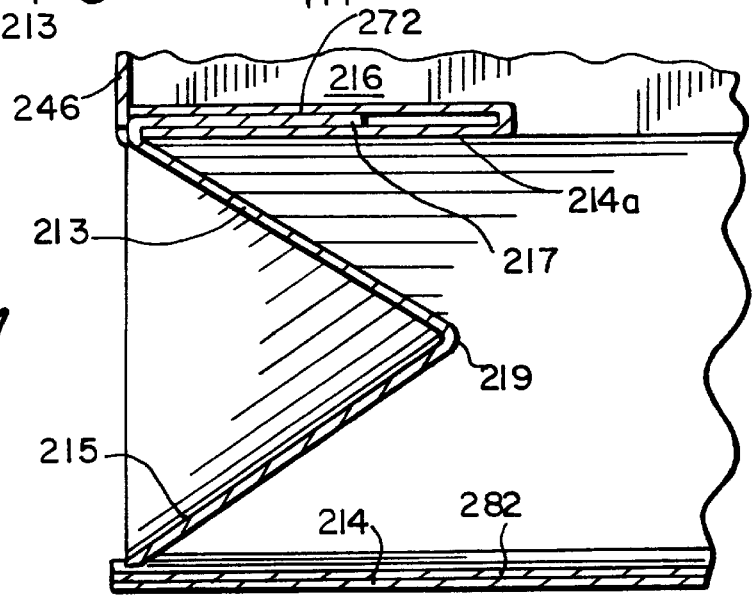
FIG.14

COLLAPSE-RESISTANT, MERCHANDISE DISPLAY

BACKGROUND OF THE INVENTION

1. Field of the Invention

This invention generally relates to a display made of corrugated board material for displaying merchandise and, more particularly, to a display movable by manual manipulation between a collapsed, storage condition and an erect, display condition and, still more particularly, to preventing this display from undersirably returning to the collapsed condition.

2. Description of the Related Art

One type of collapsible display carton is known, for example, from U.S. Pat. No. 2,708,065 and No. 2,844,297, wherein a plurality of carton walls is foldably connected to one another, and two sets of closure flaps are located at opposite end regions of the carton. Each set of closure flaps is collapsed inside the carton between the carton walls in a collapsed condition. By manual manipulation of the carton walls, each set of closure flaps unfolds and forms a generally planar, closure at each end region in an erect condition of the carton. Merchandise is loaded in the carton for display.

Another type of collapsible display carton employs one set of the closure flaps at the bottom of the carton. Manual manipulation of the carton walls causes the closure flaps to form a bottom closure on which the merchandise is supportably loaded.

The quick and easy erection of such cartons from the collapsed to the erect conditions also enables such cartons to be quickly and easily collapsed from the erect to the collapsed conditions. Although this may be desirable when such cartons are to be discarded after performing their display function, a carton that is fully, or even partly, collapsed is of no or little use when a fully erect carton is needed.

For example, when a carton having end closure flaps is transported, the collapse of the end closure flaps, or their entry back into the carton, compromises the ability of the carton to be effectively transported and loaded with merchandise. In case such cartons are to be stacked one above another, a collapsed carton within the stack can cause higher cartons to shift and/or topple. In other words, end closure flaps, due to their capability of being easily folded and unfolded between their erect and collapsed conditions, are structurally weak, especially when external forces are applied in a direction generally perpendicular to the plane of the closure toward the interior of the carton.

SUMMARY OF THE INVENTION

Objects of the Invention

Accordingly, it is a general object of the present invention to provide an improved display that is capable of being readily erected from a collapsed, storage condition to an erect, display condition, while preventing unauthorized collapse of the display.

More particularly, it is an object of the present invention to provide a display of the above character that has end closure flaps which are folded and automatically unfolded as the carton is erected to form an end closure, and to reinforce and stiffen the end closure to prevent collapse of the display.

Still another object of the present invention is to provide a display of the above character which is capable of being readily manufactured in quantity lots at relatively low cost.

It is yet another object of the present invention to provide a collapse-resistant display that is conveniently and quickly erected for loading of merchandise, and for stacking.

A concomitant object of the present invention is so to construct the display as to be relatively simple in construction, inexpensive to manufacture, easy to use, and yet reliable in operation.

FEATURES OF THE INVENTION

In keeping with these objects and others which will become apparent hereinafter, one feature of this invention resides in a collapse-resistant merchandise display that includes a back wall, a front wall, a bottom wall and a top wall. These walls are foldably connected and erectable from a collapsed condition in which the top wall is displaced along a transverse direction relative to the bottom wall, to an erect condition in which the top wall is shifted into a generally parallel, overlying relationship with the bottom wall. The back wall extends along a longitudinal direction generally perpendicular to the transverse direction between opposite end regions. The front wall is spaced along the transverse direction away from the back wall in the erect condition. The bottom wall extends between the back and front walls along the transverse direction. The walls bound an interior for receiving merchandise to be displayed. The front and top walls are open to enable viewing of, and access to, the merchandise.

The display further includes two sets of end closure flaps at said end regions, respectively. Each set includes back, front, bottom and top flaps foldably connected to the back, front, bottom and top walls, respectively. The flaps are movable between a collapsed state in which the flaps extend into said interior, and an erect state in which each set of flaps is foldable, in response to shifting of the top wall into said overlying relationship with the bottom wall, into a common, generally planar closure at a respective said end region.

In accordance with this invention, a locking panel overlies at least one of the sets of the flaps in the erect state. The locking panel extends between and engages two of the walls spaced apart from each other in a locked position to prevent movement of the flaps out of the erect state. The locking panel thus serves to reinforce the structural integrity of the closure. Preferably, two locking panels are employed, one at each end region.

In the preferred embodiment, one of the walls has a locking slot, and the locking panel has a locking tab received in the locking slot. This insures that the locking panel will not be dislodged from its locked position.

Advantageously, the locking panel is hinged to the top wall and extends between the top wall and the bottom wall. Also, the locking panel has a transverse fold line to form a top reinforcing section that lies underneath and engages the top wall in the locked position of the locking panel, as well as an upright fold line to form a front reinforcing section that lies behind and engages the front wall in the locked position of the locking panel.

The display is preferably in the form of an open tray which can be mounted on a flat supporting surface such as a shelf, or stacked with other trays. To assist such stacking, the top wall has upwardly extending mounting tabs and mounting slots, and the bottom wall has downwardly extending mounting tabs and mounting slots. The tabs of one tray are received in the slots of an adjacent tray.

As for the flaps, in the preferred embodiment, the top flap of each set has a generally diagonal, first fold line to form the top flap of two top sections. One of the top sections is secured to the front flap of each set for joint movement. The bottom flap of each set has a generally diagonal, second fold line to form the bottom flap of two bottom sections. One of the bottom sections is secured to the back flap of each set for joint movement. The first and second fold lines are parallel to each other. Also, the top and bottom flaps have notches which fittingly engage each other in the erect state.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 3 is a perspective view of the embodiment of FIG. 1 in an erect condition, and showing a locking panel during its movement toward a locked position;

FIG. 4 is a perspective view of the embodiment of FIG. 1 in the erect condition, with the locking panel in the locked position;

FIG. 8 is a front elevational view of the embodiment of FIG. 1 stacked above additional FIG. 1 embodiments;

FIG. 9 is a sectional view taken on line 9—9 of FIG. 8;

FIG. 10 is an enlarged, broken-away view of a detail of FIG. 8;

FIG. 11 is a perspective view of a second embodiment of a display in accordance with this invention in a collapsed condition;

FIG. 12 is a sectional view taken on line 12—12 of FIG. 11;

FIG. 13 is a perspective view of the embodiment of FIG. 11 in an erect condition; and FIG. 14 is an enlarged sectional view taken on line 14—14 of FIG. 13.

DETAILED DESCRIPTION OF THE PREFERRED EMBODIMENTS

Figure 1:
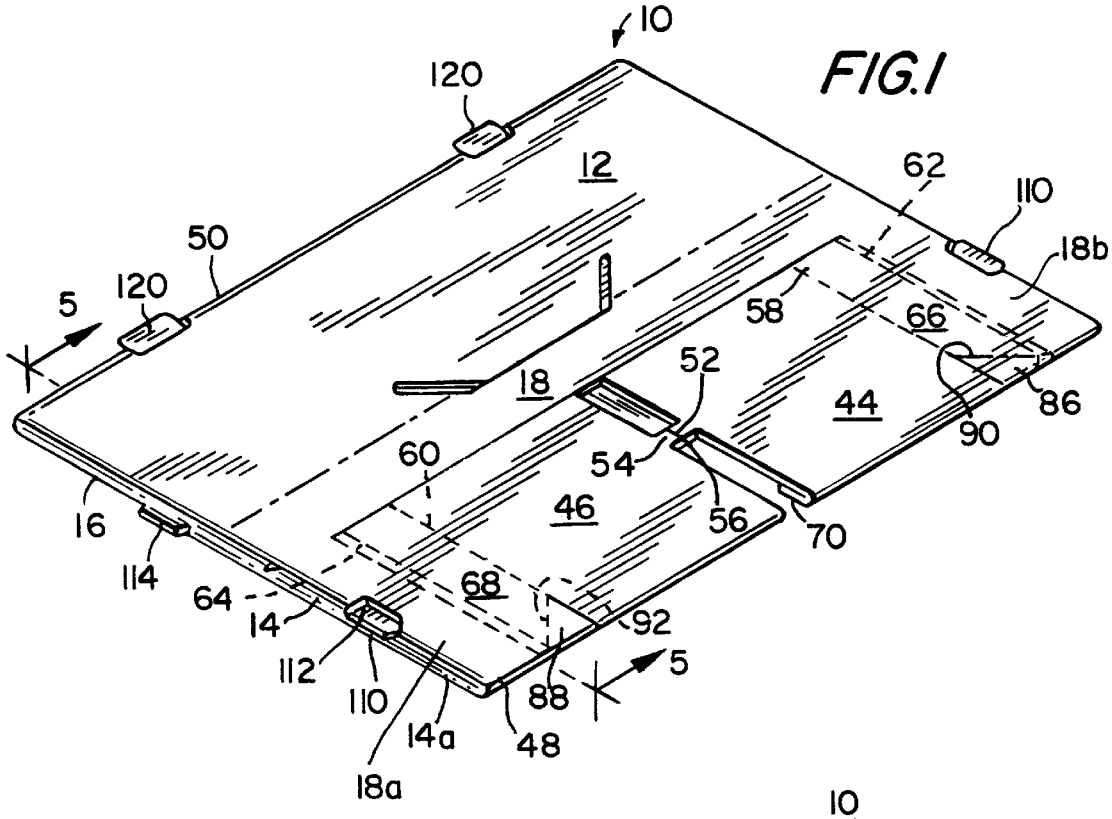
FIG. 1 is a perspective view of a first embodiment of a display in accordance with this invention in a collapsed condition.
Figure 2:
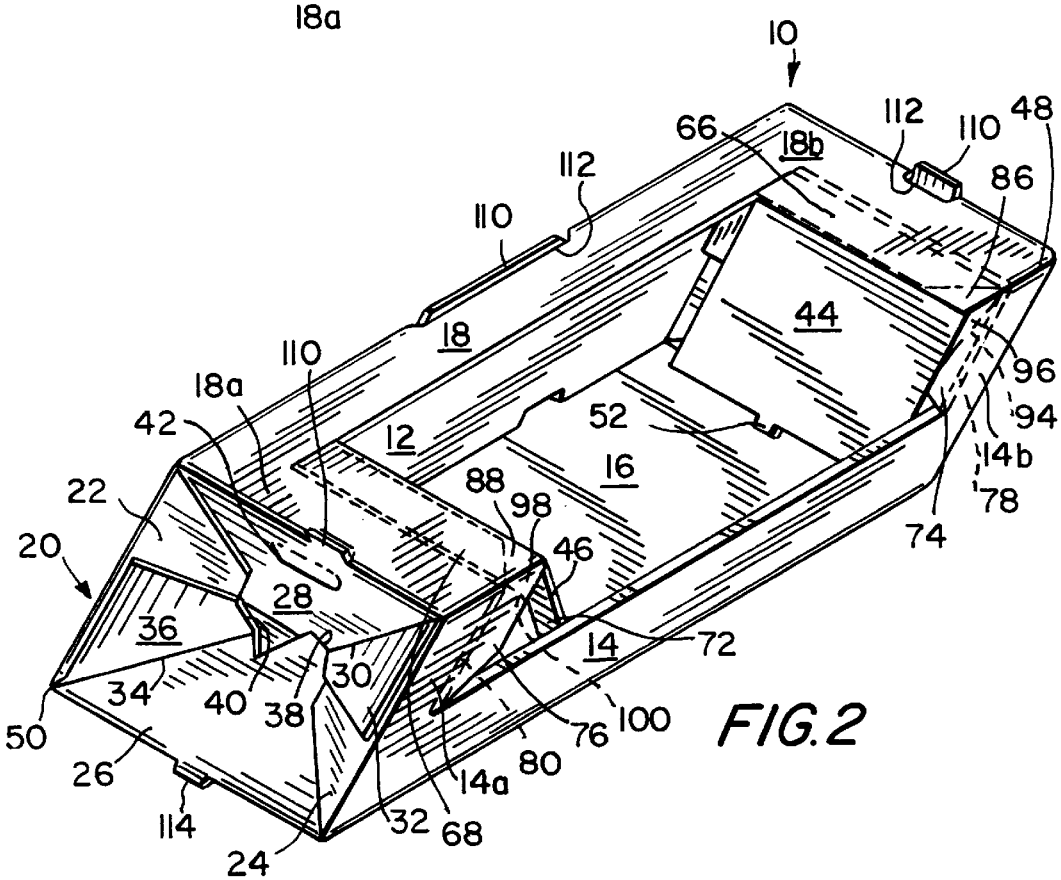
FIG. 2 is a perspective view of the embodiment of FIG. 1 in an intermediate position prior to reaching an erect condition.

Referring now to the first embodiment depicted in FIGS. 1–10, reference numeral 10 generally identifies a merchandise display shown in a collapsed, storage and transport condition in FIG. 1 and in an erect display condition in FIG. 4. Display 10 includes a back wall 12, a front wall 14, a bottom wall 16, and a top wall 18, all of these walls being generally planar. The front wall 14 includes a pair of front wall portions 14*a, b* co-planar therewith to bound a front cutout or opening through which merchandise within the display is visible and accessible from the front of the display. The top wall 18 includes a pair of top wall portions 18*a, b* co-planar therewith to bound a top cutout or opening through which the merchandise is visible and accessible from the top of the display.

The display also includes two identical sets 20 of end closure flaps at opposite end regions of the display. Each set 20 includes a back flap 22, a front flap 24, a bottom flap 26, and a top flap 28 foldably connected to the back, front, bottom and top walls 12, 14, 16 and 18, respectively. Each top flap 28 has a generally diagonal, first fold line 30 to form the top flap 28 into two top sections, one of which, namely top section 32, is secured, typically by glueing, to the front flap 24 of the respective set 20. Each bottom flap 26 has a generally diagonal, second fold line 34 to form the bottom flap 26 into two bottom sections, one of which, namely bottom section 36, is secured, typically by glueing, to the back flap 12 of the respective set 20. The first and second fold lines 30, 34 are parallel to each other. The top and bottom flaps 28, 26 have notches 38, 40 which fittingly engage each other in the erect state. The top flaps 28 also have handgrip-forming holes 42 for lifting and transport purposes.

In accordance with this invention, at least one locking panel and preferably a pair of locking panels 44, 46 overlies the sets 20 of flaps in the erect state. As described in detail below, each locking panel is preferably hinged to the top wall 18, and is manipulated into an overlying relationship with a respective set 20 so as to extend between and engage two of the walls, for example, the top wall 18 and the bottom wall 16, in a locked position that prevents movement of the flaps of each set out of the erect state.

Figure 5:
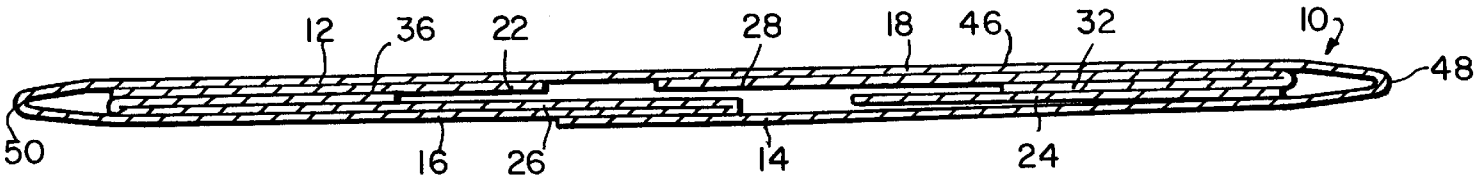
FIG. 5 is a sectional view taken on line 5—5 of FIG. 1.
Figure 7:
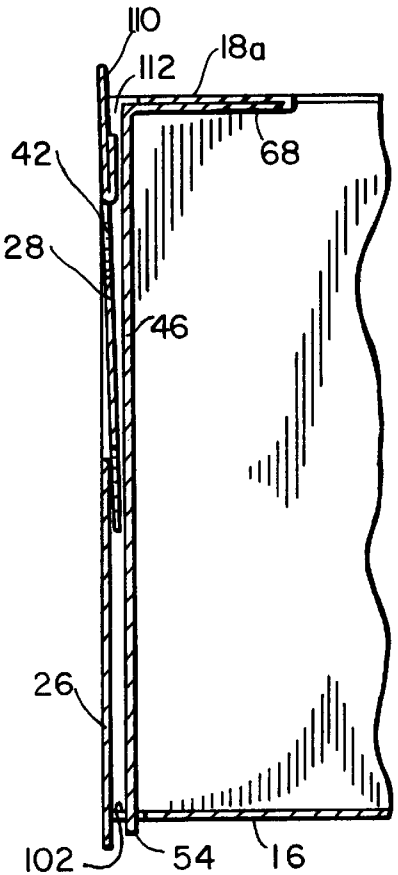
FIG. 7 is a sectional view taken on line 7—7 of FIG. 4.
Figure 6:
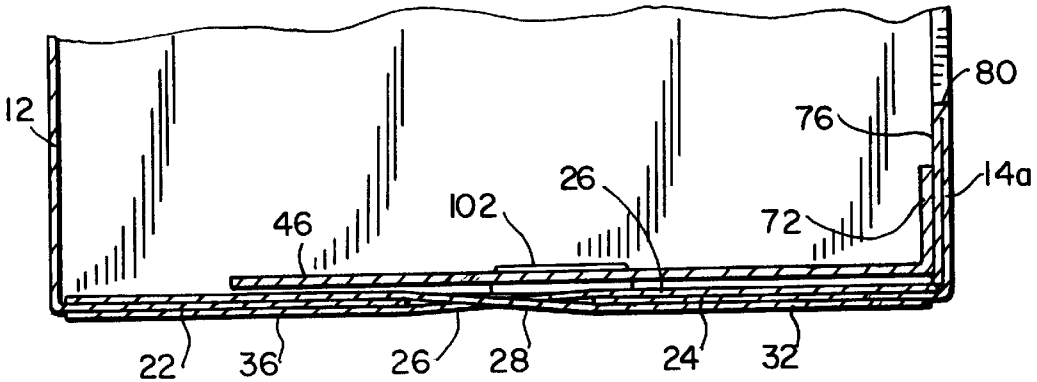
FIG. 6 is a sectional view taken on line 6—6 of FIG. 4.

As shown in FIGS. 1 and 5, in the collapsed state, the top wall 18, the back wall 12 and the locking panels 44, 46 lie in a first common plane. The front panel 14 and the bottom panel 16 lie in a second common plane. Each set 20 of flaps is inwardly folded and lies flat between these two common planes. As also seen in FIGS. 1 and 5, the top wall 18 is displaced forwardly of the bottom wall 16. Opposite linear corner edges 48 and 50 are shown to aid the following description. The display 10 is manufactured and delivered by the manufacturer in the collapsed condition.

At a merchandise loading site, the collapsed display is manually manipulated to the erect condition, principally by applying pressure between the corner edges 48, 50. This causes the top wall to be displaced rearwardly into an overlying relationship with the bottom wall. Also, the flaps of each set 20 due to their hinged connection to the moving walls start to move outwardly. The glued section 32 moves jointly with the front flap 14. The glued section 36 moves jointly with the back flap 12. The flaps of each set overlie one another in an erect state and form a pair of common, generally planar, closures at each opposite end region of the display. The notches 38, 40 engage each other in the erect state.

As previously discussed, a force, such as an accidental bump or blow, directed at an end closure causes the flaps to fold inwardly and concomitantly causes the walls to move back to the collapsed condition. Hence, in accordance with this invention, each locking panel 44, 46 is folded into an overlying relationship with a respective set 20 of flaps.

Returning to FIG. 1, the locking panels are formed from incisions and creases in the original top wall. Locking panels 44, 46 have locking tabs 52, 54 that are separated by a cut 56. Locking panels 44, 46 have first fold lines 58, 60 and second fold lines 62, 64 to form top reinforcing sections 66, 68. Locking panels 44, 46 also have front reinforcing sections 70, 72 at the corner edge 48, these front sections being formed by incisions and creases in the original front wall. Also cut from the original front wall are front stiffening sections 74, 76 that are folded over fold lines 78, 80 to engage the front wall portions 14*b, a* and stiffen the same from behind. An additional stiffening section 82 (see FIG. 9)

is cut from the original front wall and folded over fold line 84 to engage the front wall 14 and stiffen the same from behind. Section 82 has bottom tabs 83 that are received with a snap-type action in bottom slots 85 formed through the bottom wall 16. Triangular sections 86, 88 are formed by diagonal creases 90, 92 and linear corner edge 48. Additional triangular sections 96, 98 are formed by diagonal creases 94, 100 and the linear corner edge 48.

The locking panel 44 is moved to the locked position as follows: First, pressure is applied at the corner edge 48 in the region between the triangular sections 86, 96. This causes the triangular sections 86, 96 to fold over each other and positions the front stiffening section 74 behind the front wall section 14*b* to reinforce the same. At the same time, the top stiffening section 66 is folded under and positioned against the top wall section 18*b* to reinforce the same from behind. The locking panel 44 is pivoted about fold line 58 until its locking tab 52 is received with a snap-type action in a locking slot formed through the bottom wall 16. See locking slot 102 in FIG. 7 in the case of locking panel 46. The tab and slot are not strictly necessary since frictional engagement of the lower edge of the locking panel may be sufficient to provide the required locking action. Prior to reaching the locked position, the front reinforcing section 70 is folded and placed against the front stiffening section 74 to even further strengthen the front wall portion 14*b*.

The movement of the locking panel 46 is entirely analogous to that for panel 44 and will not be repeated for the sake of brevity. Once the locking panels 44, 46 are in place, the top wall portions 18*a, b* are reinforced by the top reinforcing sections 68, 66, and the front wall portions 14*a, b* are reinforced by the front reinforcing sections 72, 70 and by the front stiffening sections 76, 74. The front wall 14 is reinforced by the additional stiffening section 82. In this way, the narrow, strip-shaped sections of the top and front walls are strengthened, a feature which improves the capability of the displays being stacked, as described below.

FIG. 8 depicts a plurality of the displays 10 arranged one above another. The handhold openings 42 at either end of each display enable one to grip, lift and transport the display, especially after the erected display has been loaded with merchandise. To prevent undesired displacement of the displays, a plurality of upper mounting tabs 110 are cut from the top wall portions 18*a*, 18*b* and from the top wall 18. The cutouts vacated by the tabs 110 constitute upper mounting holes 112. Another plurality of lower mounting tabs 114 are cut from the bottom wall 16. The cutouts vacated by the tabs 114 constitute lower mounting holes 116. FIG. 10 depicts the insertion of a representative tab 110 into a representative mounting hole 116. The associated tab 114 exteriorly straddles the lower display to prevent lateral displacement. The tab 110 on the top wall 18 prevents rearward displacement.

Again returning to FIG. 1, rear tabs 120 are cut from the back wall 12 and extend in a plane co-planar with the bottom wall 16 in the erect condition. The rear tabs 120 are received in correspondingly sized apertures in an upright wall of a container (not shown) in which one or more of the displays are housed in still another type of stacking arrangement.

The entire display comprised of the walls, flaps, panels and tabs is constituted of a single piece of sheet material, preferably a corrugated board material, although cardboard could also be used. Although not preferred, the panels could be constituted as separate elements.

Another embodiment of this invention is depicted in FIGS. 11–14, wherein a display 200 is shown in collapsed and erect conditions in FIGS. 11 and 13, respectively. The display 200 includes generally planar back 212, front 214, bottom 216 and top 218 walls. The front wall 214 includes a pair of front wall portions 14*a, b* bounding a front opening. The top wall 218 includes a pair of top wall portions 218*a, b* to bound a top opening. Merchandise is accessible and visible through the top and front openings.

In contrast to the display 10, the front wall 214 of the display 200 is not co-planar with the front wall portions 214*a, b* in the erect condition, but instead is inclined or tilted forwardly. A pair of side extensions including triangular gussets or segments 213, 215 hold the front wall 214 at this orientation to provide even greater access to and room for the merchandise. Segments 215 are hinged to opposite ends of the front wall 214. Segments 213 have tabs 217 that are hooked through side slots and frictionally, adhesively or otherwise secured behind the front wall portions 214*a, b*. Fold lines 219 enable the segments 213, 215 to move, typically to enable the front wall 214 to tilt forwardly as a result of the weight of mechandise bearing on the front wall 214, thereby forming an expandable front pocket.

A set 220 of end closure flaps is provided at each end or side of the display. Each set includes back 222, front 224, bottom 226 and top 228 flaps foldably connected to the back, front, bottom and top walls, respectively. Back flap 222 has a generally diagonal, first fold line 230 to form the back flap into two back sections, one of which, namely back section 232 is secured, typically by glueing, to the top flap 228. Front flap 224 has a generally diagonal, second fold line 234 to form the front flap into two front sections, one of which, namely front section 236 is secured, typically by glueing, to the bottom flap 226. The fold lines 230, 234 are parallel to each other. The front and back flaps have notches which fittingly engage each other in the erect state.

A pair of locking panels 244, 246 overlies the sets of flaps. Each locking panel is hinged to the front wall, and is manipulated into an overlying relationship with a respective set so as to extend between and engage two of the walls, e.g., the front and the back walls in a locked position, thereby resisting movement of the flaps from the erect state.

In the collapsed state of FIG. 11, the front wall portions 214*a, b,* the top wall portions 218*a, b* and the locking panels lie in a common first plane. The front wall 214 is laid on this first plane. The back 212 and bottom 216 walls lie in a common second plane. Each set of flaps is inwardly folded and lies flat between these two planes. Top wall 218 is displaced relative to the bottom wall 216. Opposite linear corner edges 248 and 250 are also shown.

When pressure is applied between the corner edges 248, 250, the top wall is displaced toward the bottom wall and into an overlying relationship therewith. As before, the flaps begin to move outwardly to form a pair of common, generally planar, closures at opposite ends of the display.

Returning to FIG. 11, the locking panels 244, 246 are formed from incisions and creases in the original front wall. A central, vertical cut 252 separates the locking panels. First fold lines 258, 260 enable the locking panels 244, 246 to be pivoted. Second vertical fold lines 262, 24 are parallel to the first fold lines 258, 260. Top reinforcing sections 266, 268 are pivoted about the fold lines 262, 264 above a horizontal crease 265. Front reinforcing sections 270, 272 are formed between the fold lines 262, 264 and 258, 260 below the horizontal crease 265. Triangular sections 286, 288 and additional triangular sections 296, 298 are symmetrically arranged relative to the horizontal crease 265.

The locking panel 244 is moved to the locked position by applying pressure at the horizontal crease 265 in the region between the triangular sections 286, 296, thereby causing the latter to fold inwardly of the display and to overlie each other. The top stiffening section 266 is positioned underneath the top wall portion 218*b* to reinforce the same. The front stiffening section 270 is positioned behind the front wall portion 214*b* to reinforce the same. The locking panel 244 is pivoted about fold line 258 until its free edge 252 frictionally engages the back wall 212. The movement of the locking panel 246 is entirely analogous to that for panel 244 and will not be repeated for the sake of brevity.

With the locking panels 244, 246 in their locked positions, and with the top wall portions 218*a, b* reinforced from below, and with the front wall portions 214*a, b* reinforced from behind, the display 200 is not only rugged, but also will not collapse. Mounting tabs 310 on the top wall portions 218*a, b* of one display are received in mounting holes 312 of another display to permit the stacking of identical displays 200. For increased strength, the front wall 214 is doubled over along its upper longitudinal edge to form a stiffening section 282.

It will be understood that each of the elements described above, or two or more together, also may find a useful application in other types of constructions differing from the types described above.

While the invention has been illustrated and described as embodied in a collapse-resistant, merchandise display, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A collapse-resistant merchandise display, comprising:

a) a generally planar back wall, a generally planar front wall, a generally planar bottom wall having opposite end regions, and a generally planar top wall, i) said walls being foldably connected and erectable from A) a collapsed condition in which the top and back walls are co-planar, in which the bottom and front walls are co-planar, and in which the top wall is displaced along a transverse direction relative to the bottom wall, to B) an erect condition in which the front and back walls are spaced apart in mutual parallelism along the transverse direction, in which the top and bottom walls are shifted and spaced apart in an overlying, generally parallel relationship along an upright direction generally perpendicular to the transverse direction, and in which all the walls bound an interior for receiving merchandise to be displayed, ii) said front and top walls being open to enable viewing of, and access to, the merchandise in said interior;

b) two sets of end closure flaps located at the opposite end regions of the bottom wall, each set including back, front, bottom and top flaps foldably connected to the back, front, bottom and top walls, respectively, i) said flaps of each set being movable between a collapsed state in which the flaps extend into said interior, and an erect state in which the flaps are folded into a common closure in response to shifting of the top wall into said overlying relationship with the bottom wall; and c) two locking panels each overlying respective sets of the flaps in the erect state, each locking panel being hinged to the front wall and extending between and engaging the front and back walls spaced apart from each other in a locked position to prevent movement of the flaps out of the erect state.

2. The display according to claim 1, and further comprising a pocket including an inclined pocket panel and pocket flaps for securing the pocket panel on the front wall.

3. The display according to claim 1, wherein the bottom wall has two locking slots, and wherein the locking panels have respective locking tabs received in the locking slots in the locked position.

4. A collapse-resistant merchandise display, comprising:

a) a back wall, a front wall, a bottom wall and a top wall, i) said walls being foldably connected and erectable from a collapsed condition in which the top wall is displaced along a transverse direction relative to the bottom wall, to an erect condition in which the top wall is shifted into a generally parallel, overlying relationship with the bottom wall, ii) said back wall extending along a longitudinal direction generally perpendicular to the transverse direction between opposite end regions, iii) said front wall being spaced along the transverse direction away from the back wall in the erect condition, iv) said bottom wall extending between the back and front walls along the transverse direction, v) said walls bounding an interior for receiving merchandise to be displayed, and vi) said front and top walls being open to enable viewing of, and access to, the merchandise;

b) two sets of end closure flaps at said end regions, respectively, each set including back, front, bottom and top flaps foldably connected to the back, front, bottom and top walls, respectively, and movable between a collapsed state in which the flaps extend into said interior, and an erect state in which each set of flaps is foldable, in response to shifting of the top wall into said overlying relationship with the bottom wall, into a common closure at a respective said end region; and c) a locking panel hinged to the top wall and overlying at least one of the sets of the flaps in the erect state, said locking panel extending between and engaging two of the walls spaced apart from each other in a locked position to prevent movement of the flaps out of the erect state, the locking panel having an upright fold line to form a front reinforcing section that lies behind and engages the front wall in the locked position of the locking panel.

5. A collapse-resistant merchandise display, comprising:

a) a back wall, a front wall, a bottom wall and a top wall, i) said walls being foldably connected and erectable from a collapsed condition in which the top wall is displaced along a transverse direction relative to the bottom wall, to an erect condition in which the top wall is shifted into a generally parallel, overlying relationship with the bottom wall, ii) said back wall extending along a longitudinal direction generally perpendicular to the transverse direction between opposite end regions, iii) said front wall being spaced along the transverse direction away from the back wall in the erect condition and having stiffening sections folded over and engaging the front wall to stiffen the front wall, iv) said bottom wall extending between the back and front walls along the transverse direction, v) said walls bounding an interior for receiving merchandise to be displayed, and vi) said front and top walls being open to enable viewing of, and access to, the merchandise;

b) two sets of end closure flaps at said end regions, respectively, each set including back, front, bottom and top flaps foldably connected to the back, front, bottom and top walls, respectively, and movable between a collapsed state in which the flaps extend into said interior, and an erect state in which each set of flaps is foldable, in response to shifting of the top wall into said overlying relationship with the bottom wall, into a common closure at a respective said end region; and c) a locking panel overlying at least one of the sets of the flaps in the erect state, said locking panel extending between and engaging two of the walls spaced apart from each other in a locked position to prevent movement of the flaps out of the erect state.

6. A collapse-resistant merchandise display, comprising:

a) a back wall, a front wall, a bottom wall and a top wall, i) said walls being foldably connected and erectable from a collapsed condition in which the top wall is displaced along a transverse direction relative to the bottom wall, to an erect condition in which the top wall is shifted into a generally parallel, overlying relationship with the bottom wall, ii) said back wall extending along a longitudinal direction generally perpendicular to the transverse direction between opposite end regions, iii) said front wall being spaced along the transverse direction away from the back wall in the erect condition, iv) said bottom wall extending between the back and front walls along the transverse direction, v) said top wall having upwardly extending mounting tabs and mounting slots, and said bottom wall having downwardly extending mounting tabs and mounting slots, vi) said walls bounding an interior for receiving merchandise to be displayed, and vii) said front and top walls being open to enable viewing of, and access to, the merchandise;

b) two sets of end closure flaps at said end regions, respectively, each set including back, front, bottom and top flaps foldably connected to the back, front, bottom and top walls, respectively, and movable between a collapsed state in which the flaps extend into said interior, and an erect state in which each set of flaps is foldable, in response to shifting of the top wall into said overlying relationship with the bottom wall, into a common closure at a respective said end region; and c) a locking panel overlying at least one of the sets of the flaps in the erect state, said locking panel extending between and engaging two of the walls spaced apart from each other in a locked position to prevent movement of the flaps out of the erect state.

7. A collapse-resistant merchandise display, comprising:

a) a back wall, a front wall, a bottom wall and a top wall, i) said walls being foldably connected and erectable from a collapsed condition in which the top wall is displaced along a transverse direction relative to the bottom wall, to an erect condition in which the top wall is shifted into a generally parallel, overlying relationship with the bottom wall, ii) said back wall extending along a longitudinal direction generally perpendicular to the transverse direction between opposite end regions, and having rearwardly extending mounting tabs, iii) said front wall being spaced along the transverse direction away from the back wall in the erect condition, iv) said bottom wall extending between the back and front walls along the transverse direction, v) said walls bounding an interior for receiving merchandise to be displayed, and vi) said front and top walls being open to enable viewing of, and access to, the merchandise;

b) two sets of end closure flaps at said end regions, respectively, each set including back, front, bottom and top flaps foldably connected to the back, front, bottom and top walls, respectively, and movable between a collapsed state in which the flaps extend into said interior, and an erect state in which each set of flaps is foldable, in response to shifting of the top wall into said overlying relationship with the bottom wall, into a common closure at a respective said end region; and c) a locking panel overlying at least one of the sets of the flaps in the erect state, said locking panel extending between and engaging two of the walls spaced apart from each other in a locked position to prevent movement of the flaps out of the erect state.

8. The display according to claim 7, wherein the top flap of each set has a hole forming a handgrip.

9. A collapse-resistant merchandise display, comprising:

a) a back wall, a front wall, a bottom wall and a top wall, i) said walls being foldably connected and erectable from a collapsed condition in which the top wall is displaced along a transverse direction relative to the bottom wall, to an erect condition in which the top wall is shifted into a generally parallel, overlying relationship with the bottom wall, ii) said back wall extending along a longitudinal direction generally perpendicular to the transverse direction between opposite end regions, iii) said front wall being spaced along the transverse direction away from the back wall in the erect condition, iv) said bottom wall extending between the back and front walls along the transverse direction, v) said walls bounding an interior for receiving merchandise to be displayed, and vi) said front and top walls being open to enable viewing of, and access to, the merchandise;

b) two sets of end closure flaps at said end regions, respectively, each set including back, front, bottom and top flaps foldably connected to the back, front, bottom and top walls, respectively, and movable between a collapsed state in which the flaps extend into said interior, and an erect state in which each set of flaps is foldable, in response to shifting of the top wall into said overlying relationship with the bottom wall, into a common closure at a respective said end region, the top flap of each set having a hole forming a handgrip; and c) a locking panel overlying at least one of the sets of the flaps in the erect state, said locking panel extending between and engaging two of the walls spaced apart from each other in a locked position to prevent movement of the flaps out of the erect state.

10. The display according to claim 9, wherein the walls, the flaps and the locking panel are of a one-piece, sheet material construction.

11. The display according to claim 9, wherein one of the walls has a locking slot, and wherein the locking panel has a locking tab received in the locking slot in the locked position.

12. The display according to claim 9, wherein the locking panel is hinged to the top wall.

13. The display according to claim 12, wherein the locking panel has a transverse fold line to form a top reinforcing section that lies underneath and engages the top wall in the locked position of the locking panel.

14. The display according to claim 12, wherein the locking panel has an upright fold line to form a front reinforcing section that lies behind and engages the front wall in the locked position of the locking panel.

15. The display according to claim 9, wherein the locking panel extends between the top wall and the bottom wall.

16. The display according to claim 9, and further comprising another locking panel overlying the other of the sets of the flaps in the erect state, said other locking panel being longitudinally spaced from the locking panel in mutual parallelism in the erect condition.

17. The display according to claim 9, wherein the front wall has stiffening sections folded over and engaging the front wall to stiffen the front wall.

18. The display according to claim 9, wherein the top wall has upwardly extending mounting tabs and mounting slots, and wherein the bottom wall has downwardly extending mounting tabs and mounting slots.

19. The display according to claim 9, wherein the back wall has rearwardly extending mounting tabs.

20. The display according to claim 9, wherein the top flap of each set has a generally diagonal, first fold line to form the top flap of two top sections, one of the top sections being secured to the front flap of each set for joint movement.

21. The display according to claim 20, wherein the bottom flap of each set has a generally diagonal, second fold line to form the bottom flap of two bottom sections, one of the bottom sections being secured to the back flap of each set for joint movement.

22. The display according to claim 21, wherein the first and second fold lines are parallel to each other.

23. The display according to claim 21, wherein the top and bottom flaps have notches which fittingly engage each other in the erect state.

24. A collapse-resistant merchandise display, comprising:

a) a back wall, a front wall, a bottom wall and a top wall, i) said walls being foldably connected and erectable from a collapsed condition in which the top wall is displaced along a transverse direction relative to the bottom wall, to an erect condition in which the top wall is shifted into a generally parallel, overlying relationship with the bottom wall, ii) said back wall extending along a longitudinal direction generally perpendicular to the transverse direction between opposite end regions, iii) said front wall being spaced along the transverse direction away from the back wall in the erect condition, iv) said bottom wall extending between the back and front walls along the transverse direction, v) said walls bounding an interior for receiving merchandise to be displayed, and vi) said front and top walls being open to enable viewing of, and access to, the merchandise;

b) two sets of end closure flaps at said end regions, respectively, each set including back, front, bottom and top flaps foldably connected to the back, front, bottom and top walls, respectively, and movable between a collapsed state in which the flaps extend into said interior, and an erect state in which each set of flaps is foldable, in response to shifting of the top wall into said overlying relationship with the bottom wall, into a common closure at a respective said end region;

c) a locking panel overlying at least one of the sets of the flaps in the erect state, said locking panel extending between and engaging two of the walls spaced apart from each other in a locked position to prevent movement of the flaps out of the erect state; and d) a pocket including an inclined pocket panel and pocket flaps for securing the pocket panel on the front wall.

* * * * *